US007004284B2

(12) United States Patent
Chick

(10) Patent No.: US 7,004,284 B2
(45) Date of Patent: Feb. 28, 2006

(54) SCAFFOLD MOVING DEVICE

(76) Inventor: Mark C. Chick, 705 Gateswood, Florissant, MO (US) 63033

( * ) Notice: Subject to any disclaimer, the term of this patent is extended or adjusted under 35 U.S.C. 154(b) by 524 days.

(21) Appl. No.: 10/103,242

(22) Filed: Mar. 22, 2002

(65) Prior Publication Data

US 2002/0096394 A1 Jul. 25, 2002

Related U.S. Application Data

(63) Continuation of application No. 09/729,618, filed on Dec. 4, 2000, now abandoned.

(60) Provisional application No. 60/169,217, filed on Dec. 6, 1999.

(51) Int. Cl.
*E04G 3/16* (2006.01)

(52) U.S. Cl. ..... 182/16; 182/13; 182/63.1

(58) Field of Classification Search ..... 182/13, 182/16, 63.1; 180/6.5, 65.1
See application file for complete search history.

(56) References Cited

U.S. PATENT DOCUMENTS

| | | | | |
|---|---|---|---|---|
| 2,989,139 | A | | 6/1961 | Pantek et al. |
| 3,256,954 | A | | 6/1966 | Warthen |
| 3,520,382 | A | | 7/1970 | Halsey et al. |
| 3,731,758 | A | | 5/1973 | Himba |
| 3,865,203 | A | | 2/1975 | Himba |
| 3,930,548 | A | | 1/1976 | Wallraff |
| 4,053,025 | A | * | 10/1977 | Slusarenko ..... 180/2 |
| 4,088,202 | A | * | 5/1978 | Costello ..... 182/13 |
| 4,171,033 | A | | 10/1979 | Rust et al. |
| 4,275,797 | A | * | 6/1981 | Johnson ..... 180/2 |
| 4,475,611 | A | | 10/1984 | Fisher |
| 4,662,476 | A | * | 5/1987 | Ross ..... 182/13 |
| 4,915,185 | A | | 4/1990 | Olsen |
| 4,967,733 | A | * | 11/1990 | Rousseau ..... 182/13 |
| 5,090,730 | A | | 2/1992 | DuRocher et al. |
| 5,295,620 | A | | 3/1994 | Cousineau et al. |
| 5,722,506 | A | * | 3/1998 | Takai ..... 182/16 |
| 5,890,559 | A | * | 4/1999 | Busuttil et al. ..... 182/69.6 |
| 5,909,783 | A | * | 6/1999 | Berish ..... 182/146 |
| 6,039,148 | A | * | 3/2000 | Riegel ..... 182/16 |
| 6,095,267 | A | * | 8/2000 | Goodman ..... 180/6.5 |
| 6,109,390 | A | * | 8/2000 | Giannopoulos ..... 182/16 |

* cited by examiner

*Primary Examiner*—Bruce A. Lev
(74) *Attorney, Agent, or Firm*—Paul M. Denk

(57) ABSTRACT

A portable scaffold moving device for connecting to scaffolding and which provides rotary motion to a drive wheel, to move scaffolding in select directions. The portable scaffold moving device includes a power wheel, rotary driven through a perpendicular or right-angled gear reduction, receiving its rotary force from a drive shaft, and the drive shaft couples with a portable drill, which furnishes the rotational force necessary for driving the drive shaft, and its associated drive wheel. The bracket mechanism supporting the portable drill supports the drill during its delivery of rotary force to the drive shaft, and its wheel, and likewise, pivotally mounts to an outer support sleeve or tube that furnishes steering, to the drive mechanism, and consequentially to the scaffolding, during its power movement.

3 Claims, 4 Drawing Sheets

SCAFFOLD MOVING DEVICE

CROSS REFERENCE TO RELATED APPLICATION

This application is a continuation of the application having Ser. No. 09/729,618, filed on Dec. 4, 2000, now abandoned; which application is a non-provisional application filed upon the provisional application having Ser. No. 60/169,217, filed on Dec. 6, 1999, all said applications owned by a common entity.

BACKGROUND OF THE INVENTION

This invention relates primarily to a means for motivating a scaffold, generally from a portable energizing device, for shifting scaffolding about a work area.

Scaffolding has long been used in the construction industry, more particularly, the more smaller individual type of scaffolding that is used usually indoors, for completing concrete work, plastering, painting, such as in a room or building space, has been most helpful to the worker. Various types of energizing means, such as electrical motors, and the like, applied to the scaffolding to mechanize it, to provide for other than manual movement, has also been available in the art. In the current invention, the concept is to utilize a portable type of electrical appliance, such as a self-energized drill, or related type of tool from which rotary motion may be obtained, or even perhaps a drill that may be coupled by an extension cord to an electrical outlet, is herein applied for the purpose of furnishing energy to the scaffold to provide for its automatic movement, without necessitating the application of manual force by the worker or other user.

Examples of prior art style of scaffold devices can be seen in the United States patent to Rust, et al, U.S. Pat. No. 4,171,033, wherein the scaffold device discloses a wheeled frame incorporating a platform and which may be shifted about the work area.

The patent to Costello, U.S. Pat. No. 4,088,202, shows a scaffolding cart, which is electrically powered by a permanent electric motor that mounts in proximity with the wheels, to provide means for transporting the scaffolding about the work area.

The patent to Fisher, U.S. Pat. No. 4,475,611, shows a propulsion unit for a scaffold whose drive motor is energized by electrical batteries. Once again, all provided generally in the vicinity of the lower segment of the scaffold, proximate its wheeled structure.

U.S. Pat. No. 3,865,203, shows an electric motor located adjacent one of the wheels in order to provide movement to the shown scaffolding.

A similar type of structure is shown in the U.S. Pat. No. 3,731,758, to Hibma.

U.S. Pat. No. 4,053,025, to Slusarenko, shows a scaffold which includes which includes a reversible and adjustable driving and steering unit. Once again, the electric motor used to drive the scaffolding is arranged approximate its shown drive wheel.

The patent to Wallraff, U.S. Pat. No. 3,930,548, shows another motorized scaffold attachment, where the motor is arranged adjacent and in contact with its drive wheel.

The patent to Berish, U.S. Pat. No. 5,909,783, shows a motorized scaffold hoisting apparatus, wherein a motor is used to provide for hoisting of the scaffolding, during usage.

The patent to Takai, U.S. Pat. No. 5,722,506, shows a movable working platform, where apparently manual power is used to pump a pedal to achieve rotation of its drive wheel.

Finally, the patent to Ross, U.S. Pat. No. 4,662,476, shows a portable scaffold and retrofit kit therefor. The retrofit kit includes a drive wheel, with a motor attached directly thereto, to provide movement to the scaffolding.

The current invention, contrary to what is shown and described in the various prior art patents, utilizes a drive mechanism that extends upwardly in the scaffolding into proximity of the location of its user, and which has a drive shaft incorporated therein, and then utilizes a portable tool, such as a drill, electric drill, or the like, to provide rotary motion to the drive wheel, to provide movement to the scaffolding. And, since such drills usually are reversible, movement in opposite directions may be achieved to furnish precise positioning of the associated scaffold.

SUMMARY OF THE INVENTION

The principal object of this invention is to provide a scaffold moving device, that has universal, mechanical, and associated throttle assembly, in the form of an electric motor, where any type of standardized motor that is used in conjunction with a portable or electric drill, or other trigger controlled motorized device, furnishes movement to the scaffold through a drive shaft and its associated drive wheel, even while the worker is located thereon during work.

This invention contemplates the formation of an attachment means to the standard scaffolding of the type that normally incorporates, usually, four wheels at its lower corners. This attachment incorporates a drive shaft, that extends from the upper reaches of the scaffolding, down to and couples with a drive wheel, through an associated gear reducer, in order to provide a reasonable speed of movement to the drive wheel, for shifting of the scaffolding, during its usage. Under such conditions, the worker need never dismount from the scaffolding, while shifting his work position from one area to another, and can achieve such movement through controls readily disposed to him, while standing upon the adjusted scaffolding.

The upper end of the drive shaft couples with an electrical appliance that furnishes rotary drive to said shaft. This type of appliance may include a portable drill, one that may be battery operated, or perhaps even one that may coupled through an extension cord a supply of electrical energy. Other types of portable appliances may also be used, provided that they can provide rotary movement to a drive shaft, of the type as used and incorporated within the structure of this invention. Means are provided for mounting the drive shaft, or its supporting sleeves, directly to various lateral bracings provided in the scaffolding, and further mounting platform is provided in the upper region of the sleeve supporting the drive shaft, and which can stably hold electrical appliance in place, as it is coupled with the drive shaft, in preparation for its usage and application in providing motive power to the scaffolding.

It is, therefore, the principal object of this invention to provide a portable means for furnishing electromotive force to a drive shaft, and its associated drive wheel, to shift a scaffolding about a work area.

Another object of this invention is to provide a universal, scaffold moving device, which will fit with many different types of scaffolding, even when obtained from different manufacturers.

A further object of this invention is to provide a light weight portable unit, which can be easily transported and quickly installed, for use for providing motive power to scaffolding, during usage and application.

Another object of this invention is to provide a portable drive unit which may be installed by a single worker, to furnish motive force to scaffolding.

Another object of this invention is to provide a scaffolding moving device which can be controlled (steering throttle) by only one hand. Other mobile scaffold units require two hands to operate, which can leave the worker unable to hold on to the scaffold rails causing the worker to become unstable and possibly injuring himself.

Still another object of this invention is to provide a scaffold moving device, which when operated, may use a small cordless and reversible motor, with a rechargeable battery pack, for furnishing motive force to the drive wheel for such scaffolding.

A further object of this invention is to provide a scaffold moving device, with a gear reduction transmission, that produces a positive brake, while the unit is not subject to power.

Another object is to furnish a scaffold moving device, that has a zero degree of turning radius, which causes a scaffold to be extremely maneuverable and easy to operate during application.

Still another object of this invention is to provide a scaffold moving device, which has a floating drive wheel, so that the drive wheel cannot become high centered, or reduce traction, once it has been installed and located in place for adding motive force to the scaffolding.

A further object of this invention is to furnish a scaffold moving device which has a large pneumatic tire, functioning as its drive wheel, to allow the scaffolding to negotiate small obstacles on a floor, as is often found in such work conditions, as on a construction site.

Yet another object of this invention is to provide a scaffold moving device with a universal mounting bracket, which can be easily adjusted to fit different scaffolds, having a variety of heights, mounting to the various horizontal tubing or other lateral or longitudinal structure that is incorporated into the assembly of such scaffolding.

Yet another object of this invention is to provide a scaffold moving device which has a removable bar, which secures to the front wheels of the scaffolding, in a stationary position, parallel to the scaffold frame, and this prevents the scaffolding from moving sideways, while in motion, and allows precision control from its steering mechanism.

Another object of this invention is to provide a scaffold moving device that has a combination of steering, throttle and motor receptacle, which can accommodate a wide variety of electric or battery powered motors or drill type devices to furnish motive force.

Yet another object of this invention is to provide a scaffold moving device that has a universal and mechanical throttle assembly, to control the variety of standardized motors, associated with such drive devices that are normally are not utilized for purposes of this invention.

DESCRIPTION OF THE PREFERRED EMBODIMENT

Figure 1:
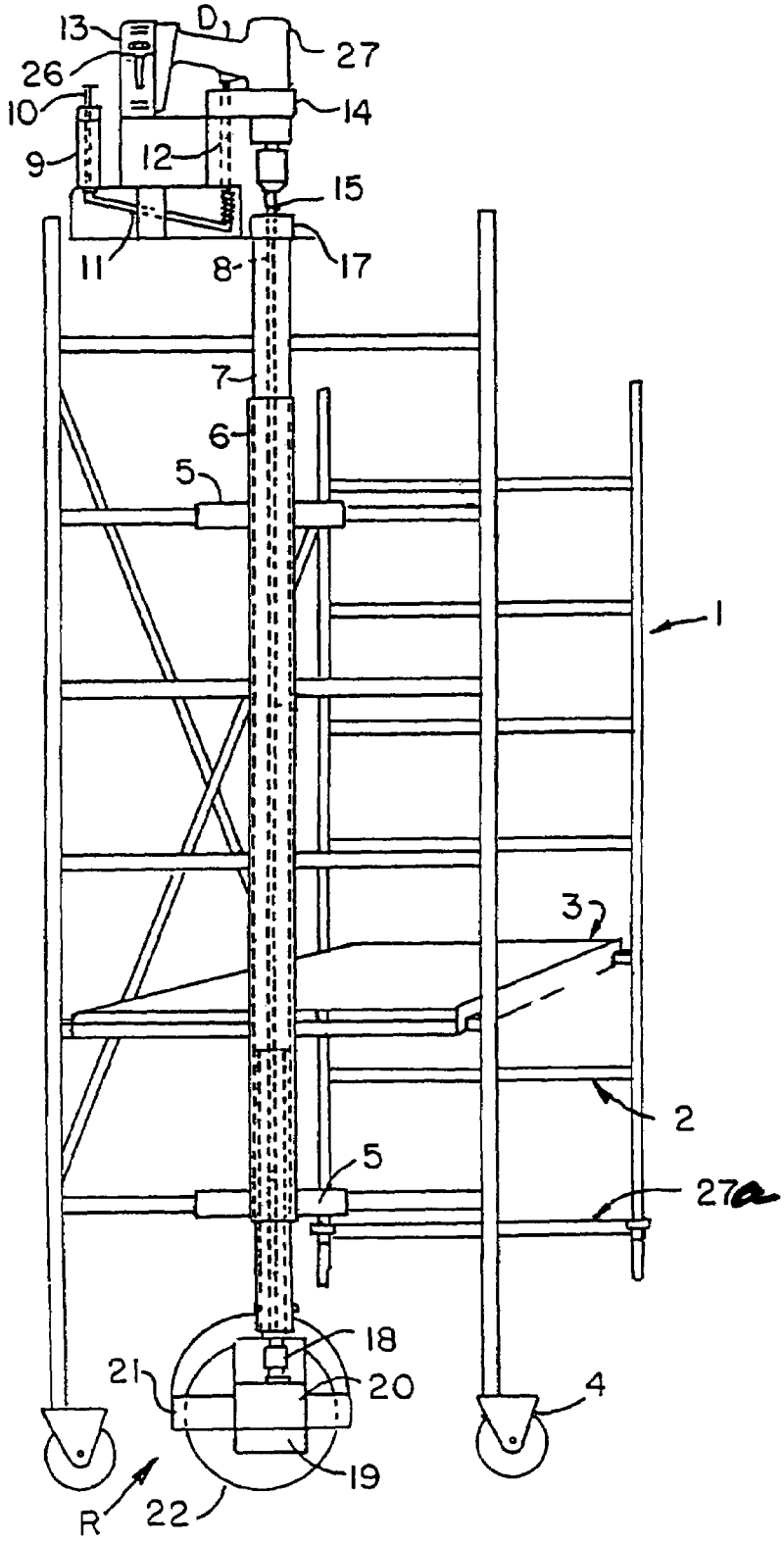
FIG. 1 provides a perspective view of scaffolding incorporating the portable drive mechanism of this invention.

In referring to the drawings, and in particular FIG. 1, a typical scaffolding consisting of four vertical columns 1, with supporting lateral or horizontal members 2, are readily disclosed, and which normally form the type of scaffolding applied at a work site, such as, for example, when performing plastering, painting, or other type of construction projects, at a work site. A work platform 3, normally is supported by the horizontal members, when assembling the scaffolding structure, and such a platform can be adjusted to various heights, by clamping onto select of the parallel arranged horizontal members, as can be understood. Typically, there are also approximately four wheels or casters 4, capable of rotating 360°, firmly mounted on the bottom of each of the vertical columns 1, as can be seen. This normally is what is used to construct standard scaffolding, for work related usage.

In accordance with this current invention, a scaffolding moving or motivating device may be attached to various parts of the scaffolding, but in the preferred embodiment, may include a hooking or securing type of mounting bracket 5, that may embrace the horizontal members 2, when attaching the driving mechanism of this invention to the standard scaffolding.

Figure 2:
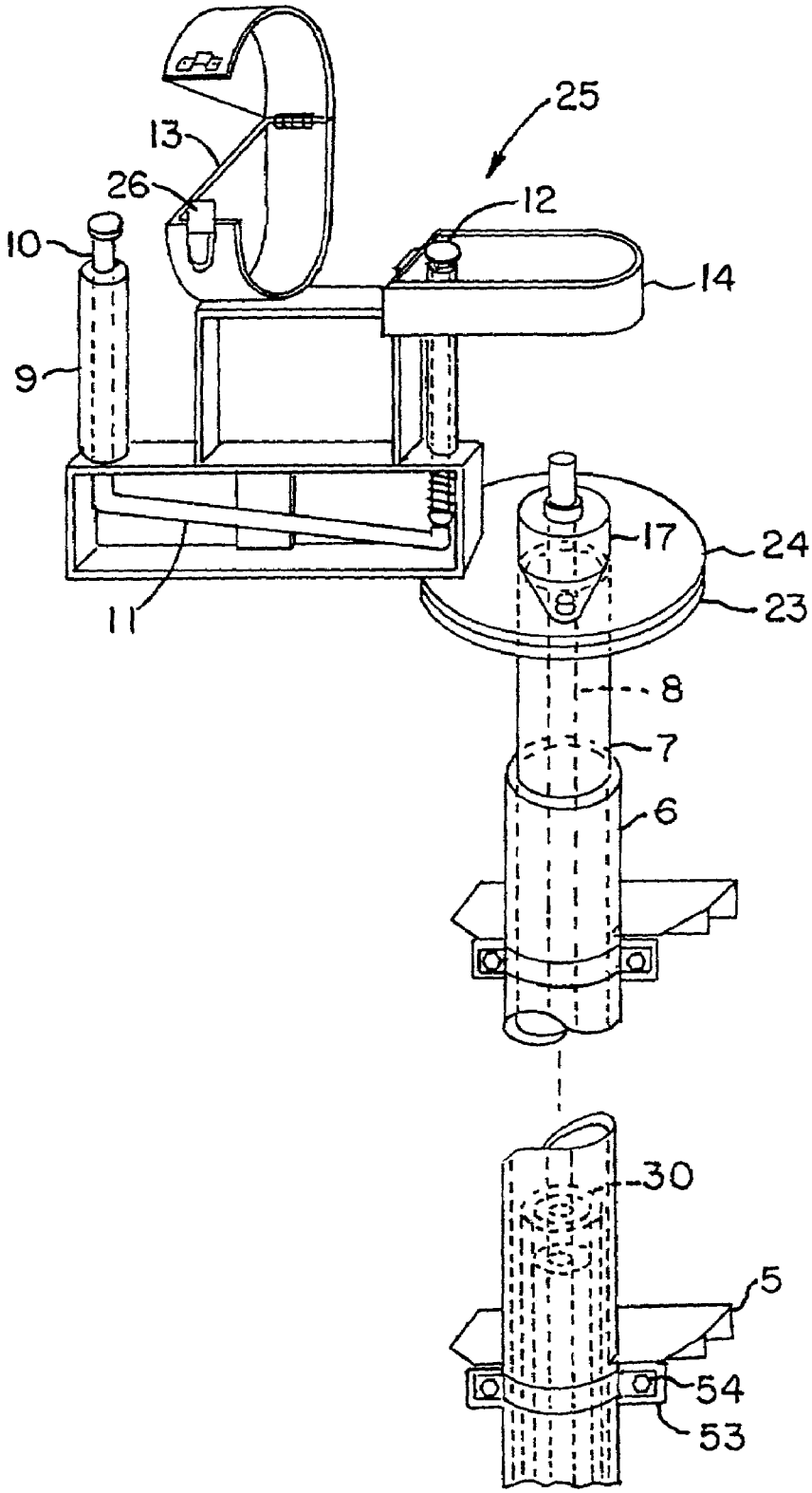
FIG. 2 shows the upper reaches of the drive mechanism disclosing the mounting bracket used for holding and coupling a portable drive appliance, such as a drill, to the drive shaft of this device.
Figure 3:
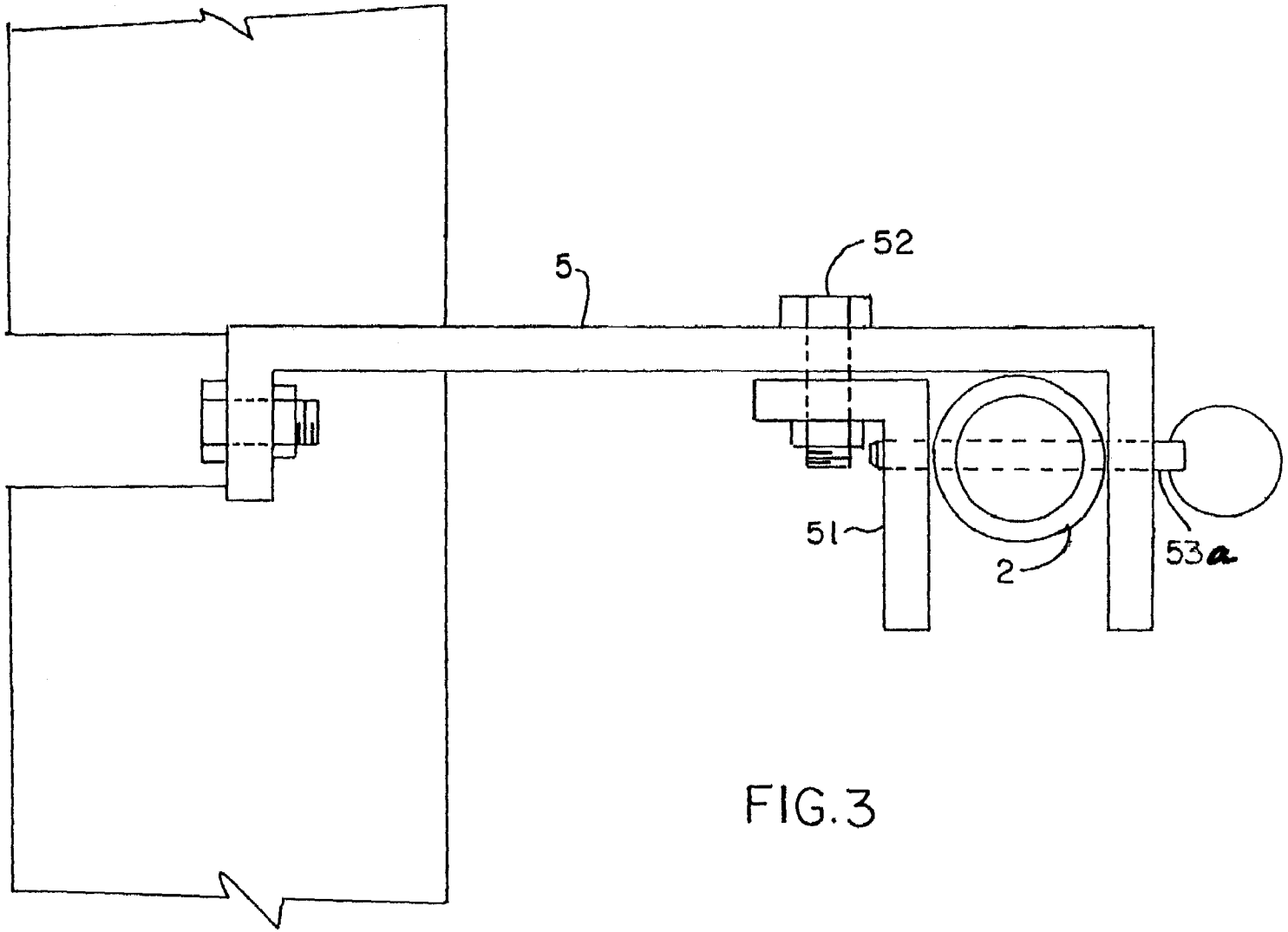
FIG. 3 provides a side view of a clamping mechanism which holds the drive shaft sleeve to the lateral bracing provided within the scaffolding of this invention.
Figure 4:
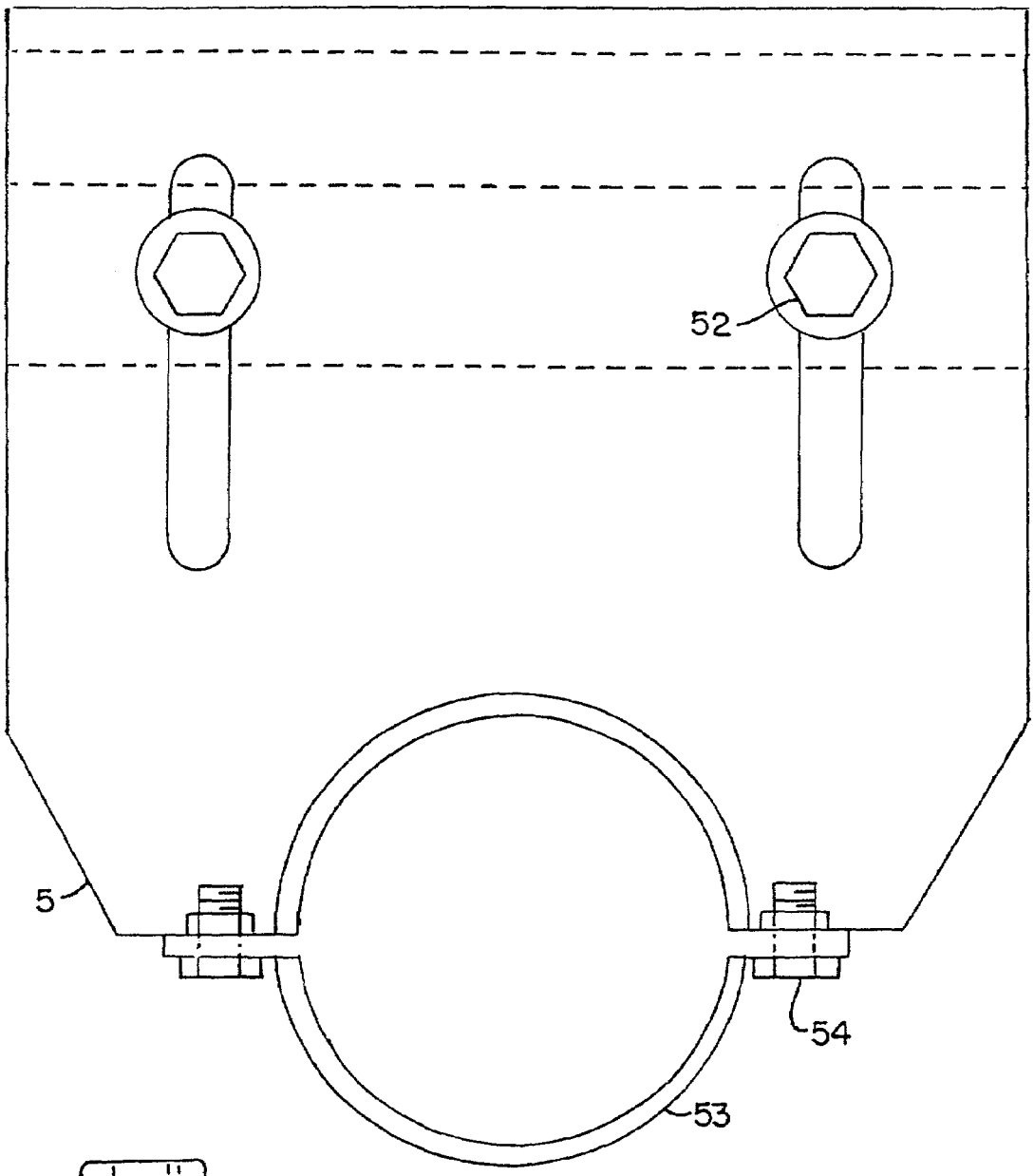
FIG. 4 is a top plan view of the bracing of FIG. 3.
Figure 5:
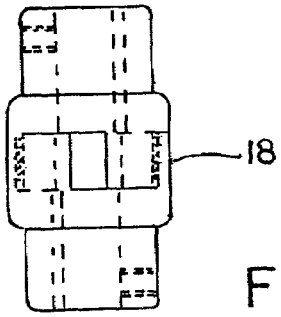
FIG. 5 discloses an intermediate style bearing that supports the drive shaft at some intermediate length along its height when assembled within the supporting sleeve of this invention.

In referring to FIGS. 3 and 4, herein is shown a universal and adjustable type of mounting bracket 5. The C-clamp 53 of the bracket hooks over the horizontal scaffold member 2, as can be noted, and is adjusted by loosening or tightening of the bolts 52, and sliding of its associated angle 51 securely against the horizontal member 2, so as to accommodate different sizes and diameters of such horizontal members, when installing the drive mechanism of this invention. Obviously, the diameter of the horizontal member 2 may vary according to different manufacturer's specifications. But, with this type of bracket, it is designed to accommodate these different sizes, during its assembly and installation. Obviously, other types of brackets could be used to provide for a securement of the drive mechanism of this invention directly to such horizontal members. In this embodiment, a hole is drilled through the horizontal member 2, and pin 53A, which connects to the bracket 5, secures the bracket to the scaffolding, as can be noted. In referring to FIG. 2, the universal mounting bracket 5 can be adjusted vertically upon its associated outer drive sleeve or tube 6, by loosening its bolts 54, and sliding the bracket 5 vertically, so as to be relocated upon different horizontal members 2, and to prevent interference with the position of the work platform 3, into its workable location.

In further referring to FIG. 1, the scaffold moving device A consists of a round tube or sleeve 6, attached to each of the mounting brackets 5, and which in turn is attached to the scaffolding, by such structure. A smaller or longer tube 7 is inserted inside of the outer tube 6, as can be noted. The outer tube 6 has a vinyl liner on the inside, that allows the inner tube 7 to slide up or down, and allows the tube 7 to turn 360°, with little friction.

In referring once again to FIG. 1, connected to the bottom of the inner tube 7 is a housing 20, which supports the right angle worm gear reduction gear box 19. Also connected to the housing 20 is a steel frame 21, which supports the pneumatic tire 22, during usage. The output of the shaft of the gear box 19 is connected to the hub of the tire 22. The other side of the tire is supported by an axle, which extends from the center of the hub, to the outer frame 21, to add stable support to the drive wheel, during usage. A drive shaft 8 runs through the center of the inner sleeve or tube 7, as noted. The drive shaft 8 is connected to the gear box 19 by a spider coupling, as can be seen at 18. A carrier bearing 30 is placed intermediate, or perhaps even midway, within the inner tube 7, and at that location prevents any sideways movement or wobbling of the drive shaft 8, during its turning, when driving the drive wheel 22. At the top of the inner tube 7 is a plate 23, which is welded to the upper end of said tube 7.

A throttle, steering and motor housing, as can be seen in FIG. 2, and as shown at 25, connects approximate the upper end of said sleeve 7. This assembly can be removed to a accommodate a different assembly, as desired, and which may be needed if an alternate power source is used, other than the cordless drill D, as disclosed in FIG. 1. The base plate 24 of the assembly 25 is secured to the plate 23, as noted. This plate is permanently attached to the tube 7, by a pair of bolts, as noted. This also secures the upper drive shaft bearing 17 in place to allow for a bearing mounting of the drive shaft 8, at the top end of the assembly. At the top of the drive shaft is a nut (not shown), which is secured by threads, and held into position by a roller pin, and this nut is secured to the drive shaft in order to accept a socket 15, which attaches to the motor 27 of the drill mechanism, as previously described.

As also disclosed in FIG. 2, the assembly 25 has three functions. It functions to furnish steering, it functions as a throttle to provide movement, and it acts as a housing to hold the portable drill and its motor in position. The throttle is activated by depressing on the rod 10, with a hand of the worker, while holding onto the hand grip 9, as shown. When downward pressure is applied to the rod 10, upward pressure is translated through the rod 12 by the connecting rod 11. As more pressure is applied to the rod 10, the more pressure is applied through the rod 12, which applies pressure to the trigger on the motor device (not shown). The bracket 13 furnishes a hinged cup, useful to secure the rear of the motor of the portable drive device, such as a drill, in place. A locking mechanism 26 is mounted onto the bracket 13, and securely holds the hinged bracket 13 in a closed position, when the portable drill, etc., is applied in place for furnishing a rotary drive force. The second bracket 14 prevents any lateral shifting or movement to the drill and its motor, once installed. In other words, it holds it firmly in position. The assembly 25 is attached to the tube 7, through its various plates, as previously explained. And, as further previously reviewed, this also attaches and directly communicates the operator, for steering purposes, through the sleeve 7, directly to turn and steer the wheel 22, during usage. With one hand on the grip, the operator can easily turn the assembly 25, which turns the drive wheel, and allows the scaffold to be guided left or right, or forwardly or in reverse, for steering purposes, when throttle power is applied.

As can further be seen in FIG. 1, a horizontal stabilizing bar 27*a* is secured into position to hold the front casters parallel, to the scaffolding, and prevent the casters from being able to move 360°. This bar is easily installed by removing of the casters, sliding the vertical columns 1 through the holes of the bar 27, and which thereafter the casters are reinstalled in place. The bar 27 is dropped down upon the casters, and the channels at the end of the bar 27 secure the casters in a reasonably fixed direction. This provides directional movement to the front casters, while the back casters are still free to swivel 360°, depending upon the movement applied by means of the drive wheel 22, during actuation. Furthermore, the bar 27*a* also adds rigidity to the scaffold vertical columns 1, and prevents the frame from twisting or swaying, when the front casters come in contact with small debris, as may be present upon the floor.

During usage and application, usually the operator of the device, when desiring to move the scaffolding, will face the front of the scaffolding, while holding the hand grip 9, as previously explained. In addition, the thumb will be applied onto the throttle controlling mechanism 10, with the thumb, similar to how an operator drives a boat with an outboard motor. As the operator applies pressure to the throttle, this is applied to the motor switch on the drill device, which begins to turn the drive shaft 8, and through the right-angled worm gears of the gear reducer 19, reduces the rpm's but allows for turning of the drive wheel 22, increases torque, and adds sufficient rotary force to drive the wheel into a driving motion, and to move the scaffolding either forwardly, or in a pivoting direction. The output shaft of the gear box is connected as an axle through the tire to provide turning to the tire, during usage. As the tire begins to turn, the scaffold becomes mobilized, and can be steered by easy turning of the assembly 25, which is connected by its various plates 23 and 24 to the sleeve 7, which in turn controls the pivot to the drive wheel 22, during usage and application.

An additional claim of this invention is the use of a portable cordless drill, with a portable rechargeable battery pack, to make any cart, dolly, or movable object, with two or more wheels, self-propelled, whether using the cordless drill to directly drive the wheel of the unit or using the cordless drill to power a gear box or transmission, which then powers the wheel or wheels, of the unit.

Variations or modifications to the structure and functionality of this invention may occur to those skilled in the art upon reviewing the disclosure as provided herein. Such variations, if within the spirit of this development, is intended to be encompassed within the scope of the invention as set forth. The description of the preferred embodiment, as set forth in view of the drawings, is provided for illustrative purposes only.

What is claimed is:

1. A scaffold comprising:

a. a scaffold frame of substantial height;

b. a drive shaft;

c. means for rotatably mounting the drive shaft to the scaffold frame;

d. a tool housing fixedly connected to the top of the drive shaft, and pivotally mounted approximate the top of the scaffold frame;

e. said means for mounting comprising mounting brackets; and f. a wheel assembly operatively associated with the bottom of the drive shaft, and extending at least in part below the scaffold frame; and wherein the drive shaft rotatably mounts in a vertical orientation on the scaffold frame, and a power drill is adapted to be connected to the tool housing for driving the drive shaft and to transfer its rotational force to rotate the wheel, and thereby move the scaffold during usage.

2. The scaffold of claim 1, wherein said tool housing pivotally mounts to the scaffold frame to allow directional movement to the scaffold during application of the scaffold moving device.

3. A scaffold comprising;

a. a scaffold frame of substantial height;

b. a drive shaft;

c. a tube having an inner diameter slightly larger than the outer diameter of the drive shaft;

d. a tool housing fixedly connected to the top of the tube, and arranged approximately at the top of the scaffold; a wheel assembly fixedly connected to the bottom of the tube, and extending at least in part below the bottom of the frame;

e. mounting brackets holding the tube for pivotal connection to the scaffold frame in a vertical orientation, the drive shaft is arranged inside the tube, said drive shaft connecting with the wheel assembly, a rotational tool comprising a portable drill adapted to be placed in the tool housing, and connected therein to the top of the drive shaft to enable to the tool to transfer its forward and reverse rotational force through the drive shaft to rotate the wheel and thereby move the scaffold.

* * * * *